US005232262A

United States Patent [19]

Tseng

[11] Patent Number: 5,232,262

[45] Date of Patent: Aug. 3, 1993

[54] ARM OF AN ARMCHAIR WITH MEANS TO SUPPORT A BOTTLE OR A CUP

[75] Inventor: Chuen-Jong Tseng, Chu-Chee Hsiang, Taiwan

[73] Assignee: Shin Yeh Enterprise Co., Ltd., Chiayi Hsien, Taiwan

[21] Appl. No.: 861,927

[22] Filed: Apr. 1, 1992

[51] Int. Cl.[5] ..... A47C 7/72; A47C 7/68

[52] U.S. Cl. ..... 297/194; 224/275; 248/311.2

[58] Field of Search ..... 297/194; 248/311.2; 224/275

[56] References Cited

U.S. PATENT DOCUMENTS

| | | | |
|---|---|---|---|
| 3,637,184 | 1/1972 | O'Brien | 248/311.2 |
| 4,826,058 | 5/1989 | Nakayama | 224/275 |
| 4,863,134 | 9/1989 | Young et al. | 297/194 |
| 5,060,899 | 10/1991 | Lorence et al. | 297/194 |

*Primary Examiner*—Alexander Grosz

*Attorney, Agent, or Firm*—Harness, Dickey & Pierce

[57] ABSTRACT

An arm of an armchair includes a tubular member having a free end. A holding frame is telescopically mounted in the tubular member from the free end. The holding frame includes a top wall formed with a retaining hole, two opposite side walls and an open bottom. The top wall and the side walls define a receiving space. An angled supporting plate is provided below the top wall. The supporting plate includes a first sheet having a first side pivoted to the holding frame and a second side opposite to the first side and a second sheet extending from the second side. The first sheet abuts a peripheral edge of the free end so as to permit the second sheet to be parallel with the top wall and to be in alignment with the retaining hole when the holding frame extends out of the tubular member. The first sheet is pushed to rotate so as to enable the second sheet to extend toward the top wall and to enable the supporting plate to be received in the receiving space when the holding frame is retracted into the tubular member.

3 Claims, 6 Drawing Sheets

ARM OF AN ARMCHAIR WITH MEANS TO SUPPORT A BOTTLE OR A CUP

BACKGROUND OF THE INVENTION

1. Field of the Invention

This invention relates to an arm of an armchair, more particularly to an improved arm of an armchair, which arm has a holding frame for supporting a cup, a bottle or the like.

2. Description of Related Art

Arms of an armchair are provided for hands to rest thereon. Generally, arms of armchairs are not provided with holding frames for supporting cups, bottles or the like, although arms of armchairs in a train or a bus are provided with ash-trays. It is inconvenient to provide a table near people for placing a cup, a bottle or the like thereon when they are seated on a chair and wish to have a cup of tea or a bottle of drink provided nearby.

SUMMARY OF THE INVENTION

Therefore, the objective of this invention is to provide an arm of an armchair, which arm has a holding frame for supporting a cup or a bottle.

Accordingly, an arm of an armchair includes a horizontally extending tubular member having a surrounding wall and a free end. A holding frame is telescopically mounted in the tubular member from the free end of the tubular member. The holding frame includes a top wall, two opposite side walls extending downwardly from the top wall and an open bottom. The top wall and the side walls define a receiving space therebetween. The top wall is formed with a retaining hole. An angled supporting plate is provided below the top wall. The supporting plate includes a first sheet having a first side pivoted to the holding frame and a second side opposite to the first side and a second sheet extending from the second side. The first sheet abuts a peripheral edge of the free end of the tubular member so as to permit the second sheet to be parallel with the top wall and to be in alignment with the retaining hole when the holding frame extends out of the tubular member. The first sheet is pushed to rotate by the peripheral edge of the free end of the tubular member so as to enable the second sheet to extend toward the top wall and to enable the supporting plate to be received in the receiving space when the holding frame is retracted into the tubular member.

BRIEF DESCRIPTION OF THE DRAWING

Other features and advantages of the present invention will become apparent in the following detailed description of the preferred embodiments, with reference to the accompanying drawings, of which.

DETAILED DESCRIPTION OF THE INVENTION

Figure 1:
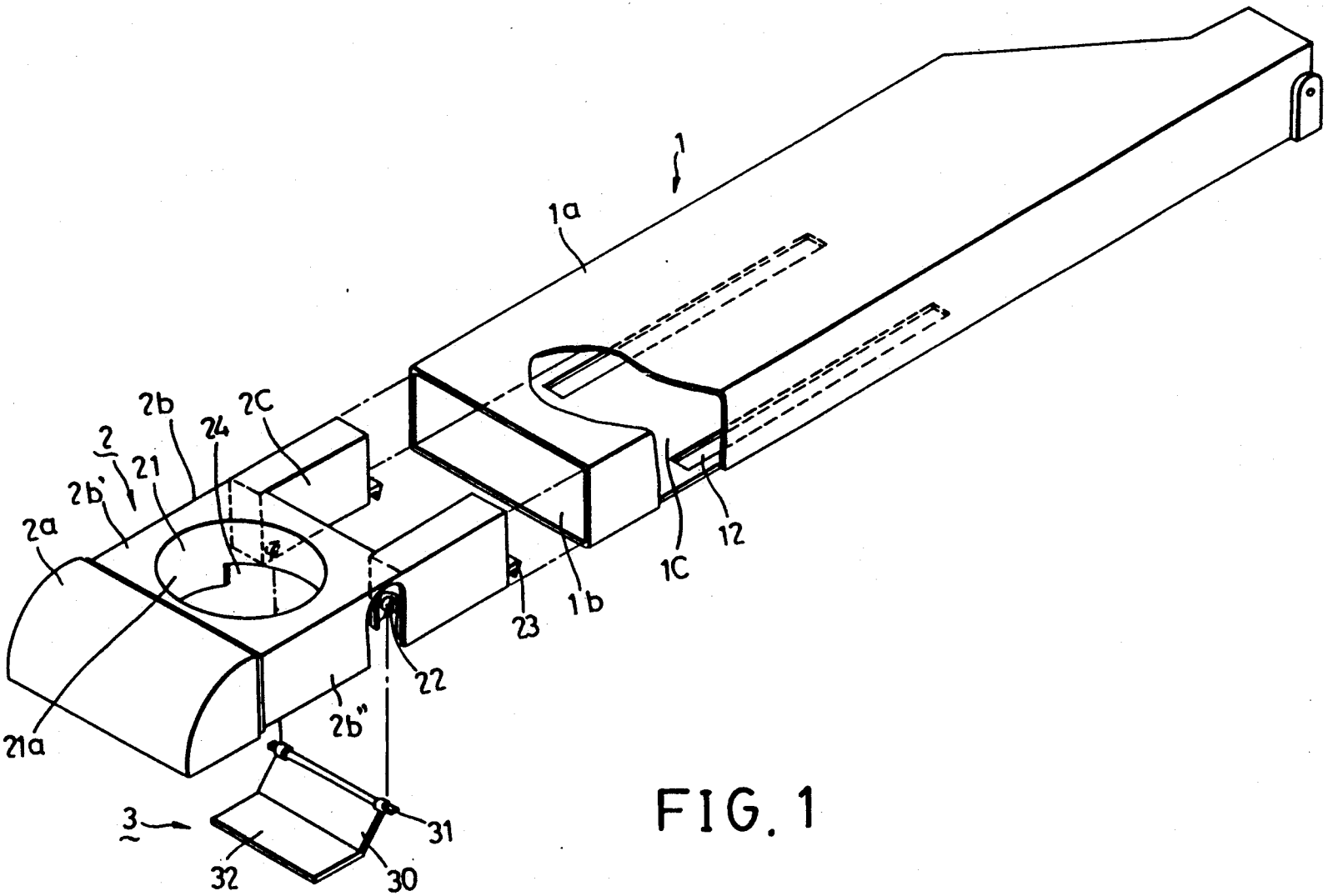
FIG. 1 is an exploded view of an arm of an armchair of this invention.
Figure 2:
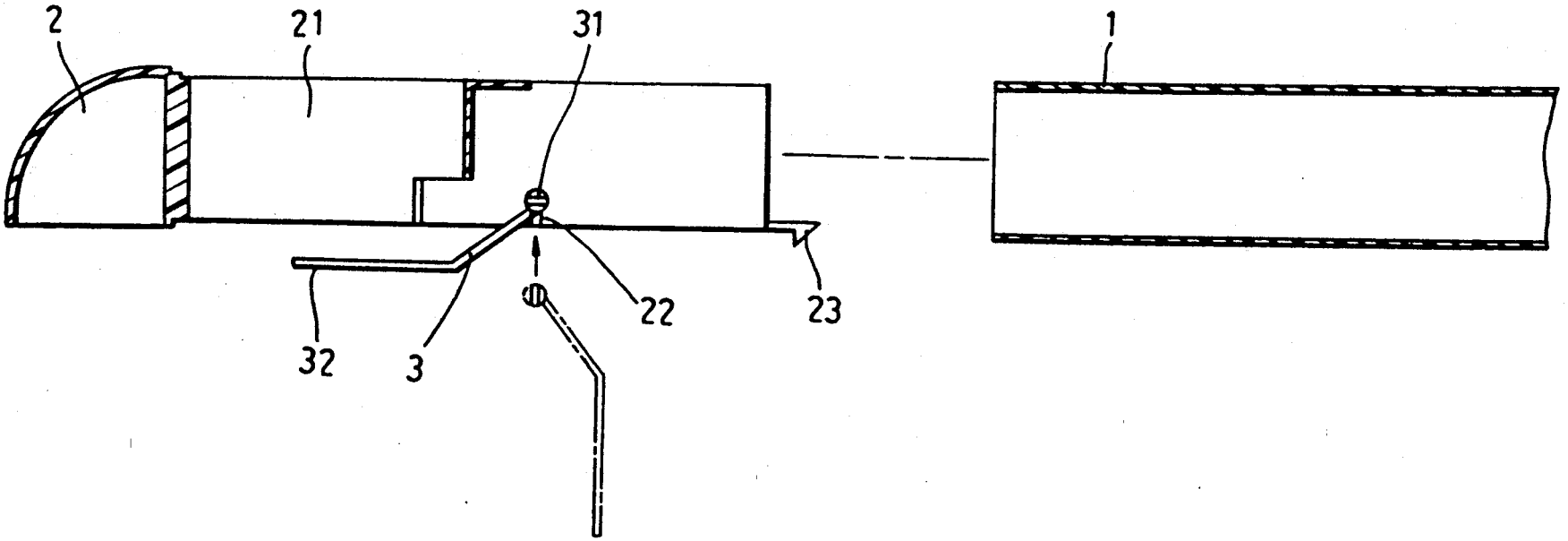
FIG. 2 shows an angled supporting plate mounted onto the holding frame of this invention.

Referring to FIGS. 1 and 2, an arm of this invention for an armchair includes a horizontally extending tubular member (1) which has a surrounding wall (1*a*) and a free end (1*b*). The surrounding wall (1*a*) includes a bottom side (1*c*) having a pair of longitudinally extending grooves (12) formed thereon. A holding frame (2) includes a first portion (2*a*) and a second portion (2*b*) which is telescopically mounted in the tubular member (1) from the free end (lb) of the tubular member (1). The second portion (2*b*) of the holding frame (2) includes a top wall (2*b*'), two opposite side walls (2*b*'') extending downwardly from the top wall (2*b*') and an open bottom. The top wall (2*b*') and the side walls (2*b*'') define a receiving space therebetween. The top wall (2*b*') is formed with a circular retaining hole (21) adjacent to the first portion (2*a*). A flange (21*a*) axially extends from a periphery of the retaining hole (21). The side walls (2*b*'') of the second portion (2*b*) have two opposite inner faces (2*c*) extending downwardly from the top wall (2*b*'). The inner faces (2*c*) are formed with aligned engaging holes (22) at lower ends of the inner faces (2*c*) and are further respectively formed with downwardly extending slits to access the engaging holes (22). The flange (21*a*) has a notch (24) formed thereon adjacent to the inner faces (2*c*). The holding frame (2) further includes a pair of tongues (23) mounted on a rear end of the second portion (2*b*) to be slidably received in the grooves (12).

An angled supporting plate (3) is provided below the top wall (2*b*') of the second portion (2*b*). The supporting plate (3) includes a first sheet (30) having a first side and a second side opposite to the first side and a second sheet (32) extending from the second side. The supporting plate (3) further includes a pivot shaft (31) which is secured on the first side of the first sheet (30) and which has flattened ends rotatably received in the engaging holes (22). The width of each flattened end of the pivot shaft (31) corresponds with the diameter of each engaging hole (22), and the thickness of each flattened end of the pivot shaft (31) corresponds with the width of each slit so as to prevent the disengagement of the pivot shaft (31) from the engaging holes (22) after the pivot shaft (31) has been mounted on the holding frame (2).

Figure 3:
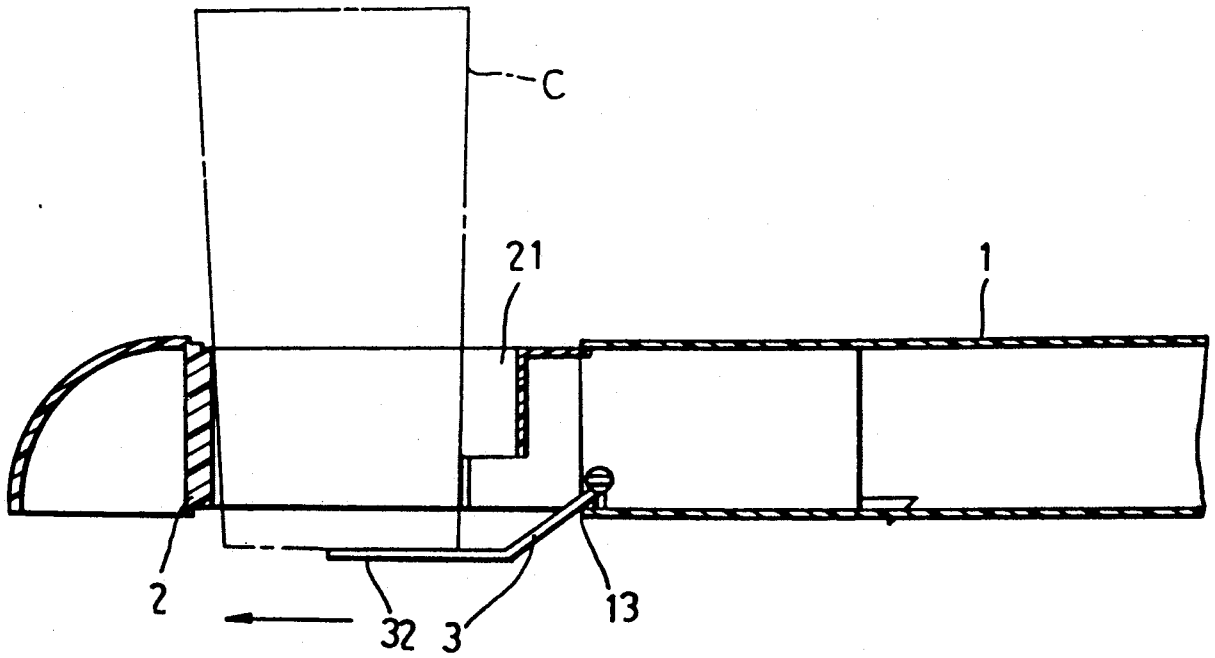
FIG. 3 shows the holding frame extending out of the tubular member.
Figure 4:
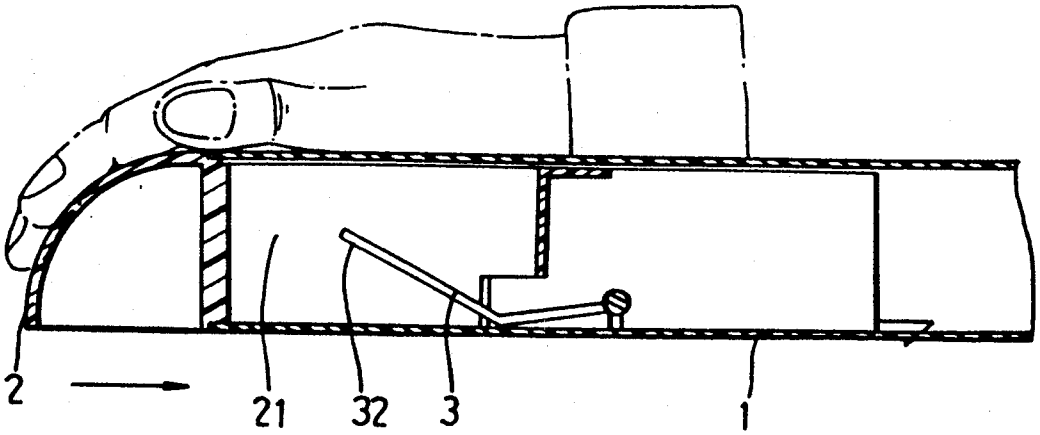
FIG. 4 shows the holding frame being retracted into tubular member.

Referring to FIG. 3, the first sheet (30) of the supporting plate (3) abuts a peripheral edge (13) of the free end (1*b*) of the tubular member (1) so as to permit the second sheet (32) to be provided below the receiving space between the top wall (2*b*') and the side walls (2*b*''), parallel with the top wall (2*b*'), and to be in alignment with the retaining hole (21) when the holding frame (2) extends out of the tubular member (1). Therefore, a cup (C) can be supported in the holding frame (2). Referring to FIG. 4, the first sheet (30) is pushed to rotate by the peripheral edge (13) of the free end (1*b*) so as to enable the second sheet (32) of the supporting plate (3) to extend toward the top wall (2*b*') through the notch (24) and to enable the supporting plate (3) to be received in the receiving space between the top wall (2*b*') and the side walls (2*b*'') when the second portion (2*b*') of the holding frame (2) is retracted into the tubular member (1). The periphery of a rear end of the first portion (2*a*) of the holding frame (2) matches with the periphery of the free end (1*b*) of the tubular member (1) so that the tubular member (1) and the holding frame (2)

cooperatively define an arm which has a good appearance.

Figure 5:
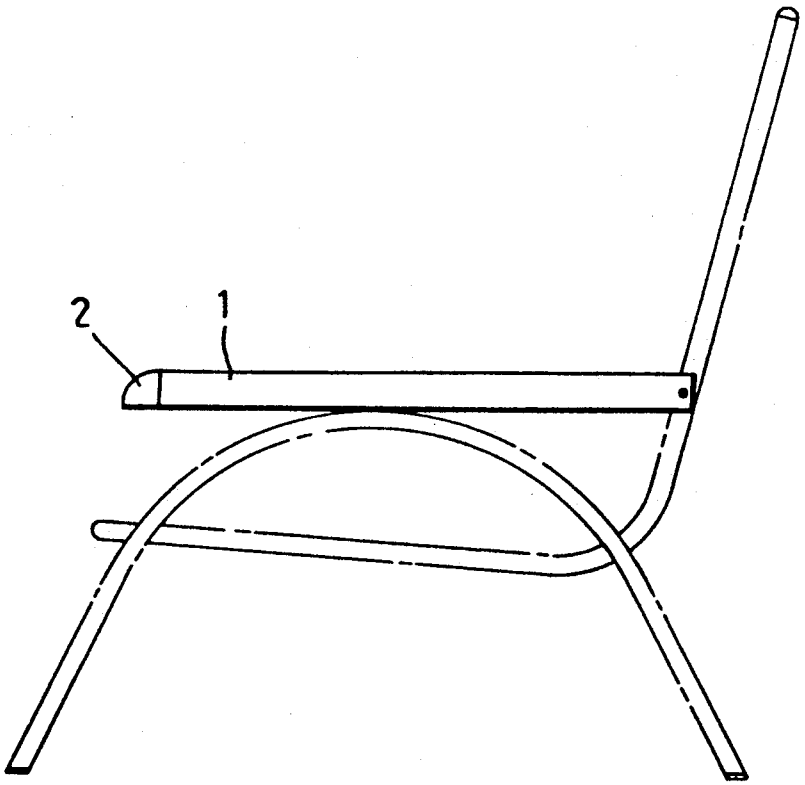
FIG. 5 and 6 show the arm of this invention when provided on an armchair.
Figure 6:
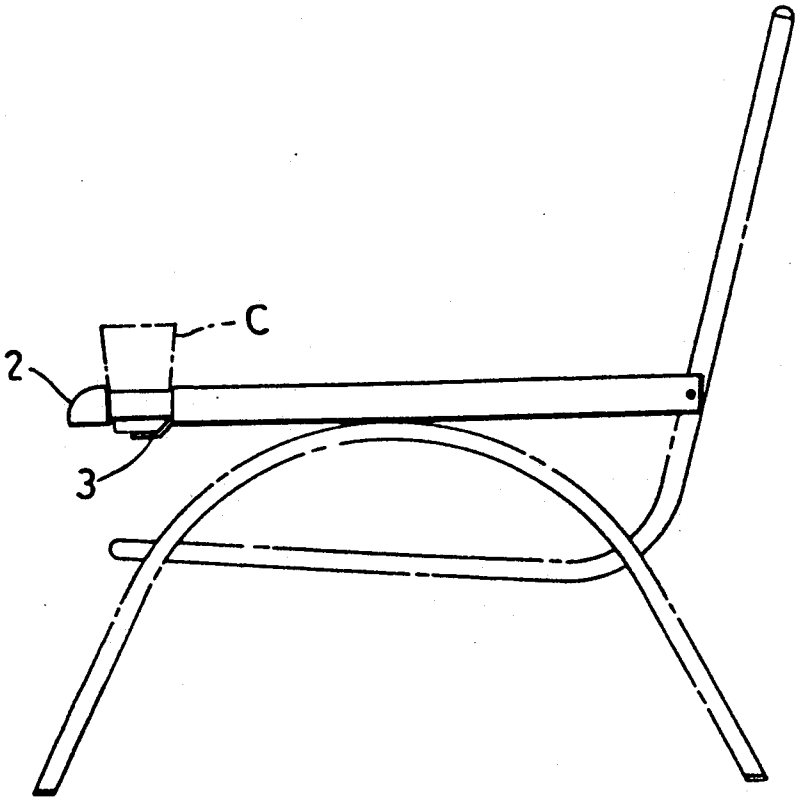

FIGS. 5 and 6 show the arm of this invention when provided on an armchair. It is convenient for a person who is seated in the armchair to place a cup (C) in the holding frame (2) without providing a table nearby.

While the present invention has been described in connection with what is considered the most practical and preferred embodiment, it is understood that this invention is not limited to the disclosed embodiments but is intended to cover various arrangements included within the spirit and scope of the broadest interpretations and equivalent arrangements.

I claim:

1. An arm of an armchair comprising:

a horizontally extending tubular member having a surrounding wall and a free end;

a holding frame telescopically mounted in said tubular member from said free end of said tubular member, said holding frame including a top wall, two opposite side walls extending downwardly from said top wall and an open bottom, said top wall and said side walls defining a receiving space therebetween, said top wall being formed with a retaining hole; and an angled supporting plate provided below said top wall, said supporting plate including a first sheet having a first side pivoted to said holding frame and a second side opposite to said first side and a second sheet extending from said second side, said first sheet abutting a peripheral edge of said free end of said tubular member so as to permit said second sheet to be parallel with said top wall and to be in alignment with said retaining hole when said holding frame extends out of said tubular member, said first sheet being pushed to rotate by said peripheral edge of said free end of said tubular member so as to enable said second sheet to extend toward said top wall and to enable said supporting plate to be received in said receiving space when said holding frame is retracted into said tubular member.

2. An arm as claimed in claim 1, wherein said surrounding wall of said tubular member has a longitudinally extending groove formed therein, said holding frame having a tongue slidably received in said groove.

3. An arm as claimed in claim 1, wherein said side walls of said holding frame have two opposite inner faces which are respectively formed with aligned engaging holes at lower ends of said inner faces and which are further respectively formed with downwardly extending slits to access said engaging holes, said supporting member including a pivot shaft which is secured on said first side of said first sheet of said supporting plate and which has flattened ends rotatably received in said engaging holes.

* * * * *